US006561487B2

(12) United States Patent
Siglock

(10) Patent No.: US 6,561,487 B2
(45) Date of Patent: May 13, 2003

(54) ADJUSTABLE STABILIZER FOR JACKS

(75) Inventor: John V. Siglock, Sierra Madre, CA (US)

(73) Assignee: Larin Corporation, Ontario, CA (US)

( * ) Notice: Subject to any disclaimer, the term of this patent is extended or adjusted under 35 U.S.C. 154(b) by 0 days.

(21) Appl. No.: 10/045,984

(22) Filed: Oct. 26, 2001

(65) Prior Publication Data

US 2002/0121632 A1 Sep. 5, 2002

Related U.S. Application Data

(60) Provisional application No. 60/243,923, filed on Oct. 27, 2000.

(51) Int. Cl.[7] ..... B66F 3/00
(52) U.S. Cl. ..... 254/134
(58) Field of Search ..... 254/134, 133 R, 254/DIG. 16, 10 R, 10 B, 10 C

(56) References Cited

U.S. PATENT DOCUMENTS

| | | | | |
|---|---|---|---|---|
| 3,773,293 A | * | 11/1973 | Arnes | 254/134 |
| 4,077,607 A | | 3/1978 | Lovelady | |
| 4,457,492 A | | 7/1984 | Lahti | |
| 5,139,233 A | * | 8/1992 | Goss | 254/134 |
| 5,294,098 A | * | 3/1994 | Bundy | 254/134 |
| 5,297,779 A | * | 3/1994 | Collins et al. | 254/98 |
| 5,538,308 A | | 7/1996 | Floe | |
| 5,588,639 A | | 12/1996 | Holman | |
| 5,601,277 A | | 2/1997 | Larson | |
| 5,769,396 A | | 6/1998 | Tischendorf | |
| 6,050,546 A | | 4/2000 | Peschmann et al. | |
| 6,089,545 A | * | 7/2000 | Norman et al. | 254/131 |
| 6,168,138 B1 | | 1/2001 | Dhein | |
| 6,199,828 B1 | * | 3/2001 | Komperud | 254/100 |
| 6,257,552 B1 | * | 7/2001 | Crow et al. | 254/134 |

OTHER PUBLICATIONS

Larin—ATV/Motorcycle Hydraulic Lift.

* cited by examiner

*Primary Examiner*—Robert C. Watson
(74) *Attorney, Agent, or Firm*—Kenneth L. Sherman, Esq.; Sherman & Sherman; Vic Y. Lin, Esq.

(57) ABSTRACT

In combination with a jack having a head, a removable adapter assembly includes an adapter frame and three-degree-of-movement adapter arms. The adapter frame has threaded holes and a connector for releasably attaching the frame to the head of the jack. The adapter is preferably rectangular. The three-degree-of-movement adapter arms are rotatably inserted into a respective one of the threaded holes for raising and lowering each of the arms with respect to the frame. The arms each have a threaded portion with a top end, a horizontal head portion having a closed slot, and a cushioned receiver. The head portion is fixedly attached to the top end of the threaded portion and the cushioned receiver is rotatably and slidably mounted in the slot.

22 Claims, 5 Drawing Sheets

ADJUSTABLE STABILIZER FOR JACKS

CROSS-REFERENCE TO RELATED APPLICATION

This application claims the benefit of U.S. Provisional Application No. 60/243,923, filed Oct. 27, 2000.

BACKGROUND OF THE INVENTION

1. Field of the Invention

The invention lies in the field of lifting equipment. The invention relates to a lifting device used to lift motorcycles or other suitable loads, especially suitable for loads having a low ground clearance. The lifting device of the present invention provides additional stability and improved safety. Also provided is an adjustable stabilizing element that can be used with the lifting device of the present invention or with conventional jacks, particularly jacks for motorcycles and/or all-terrain vehicles.

2. Description of the Related Art

Generally, different types of jacks exist in the prior art for lifting motorcycles or similar loads, such as hydraulic jacks, articulated jacks, and screw operated jacks.

U.S. Pat. No. 6,168,138 to Dhein describes a universal lift system for use in combination with a conventional hydraulic floor jack. The universal lift system replaces the mounting bracket on the floor jack with a substantially H-shaped attachment device having a kingpin that fits into a hole on the conventional jack. The lift system also includes a separate stabilizing device that attaches to the bottom of the floor jack. The lift system has a third separate part called an adjustable support device. The lift system is particularly suitable for lifting and supporting two-wheeled motorized vehicles. The universal lift system, however, is not configured to lift and support objects having a small floor-to-object clearance.

U.S. Pat. No. 4,457,492 to Lahti discloses a lifting apparatus for lifting a load, such as a motorcycle. The Lahti apparatus uses a lever operable cam to raise or lower the load. The Lahti apparatus, however, is not suitable for lifting and supporting objects having a small floor-to-object clearance. In fact, the clearance must be greater than the overall height of the Lahti apparatus, to wit, from the casters to the top of the load support.

U.S. Pat. No. 5,588,639 to Holman teaches a single-person operable support structure for lifting a motorcycle in combination with a common hydraulic floor jack. The support structure can support a motorcycle on the common jack in a variety of angular orientations. The Holman structure is limited to objects having a floor-to-bottom clearance that is greater than the sum of the height of the Holman retrofit structure plus the height of the common floor jack.

U.S. Pat. No. 5,601,277 to Larson is drawn to a two-piece jacking system for two-wheeled vehicles including a jacking mechanism and an adjustable separate support stand. Both the jacking mechanism and the stand have adjustable threaded bolts for adjusting the devices when they are placed on uneven support surfaces. Again, the Larson structure is limited to objects having a floor-to-bottom clearance that is greater than the height of the Larson jacking mechanism.

U.S. Pat. No. 5,769,396 to Tischendorf discloses a multi-purpose motorcycle lift somewhat similar to the Lahti apparatus. A foot-operated stirrup is directly connected to one, of a pair of lifting beams connected to support bars. When the stirrup is pressed downwards, the lifting beams are forced to pivot and raise the support bars, with the motorcycle, until the lifting beams are moved past the vertical. Again, the Tischendorf structure is limited to raising objects having a floor-to-bottom clearance that is greater than the height of the entire Tischendorf structure before it is rotated to raise the lifting beams. The lifting beams are individually adjustable to correspond to lifting points on the motorcycle that are uneven with respect to ground.

U.S. Pat. No. 4,077,607 to Lovelady describes a complex service rack for motorcycles, the rack having a platform to support the motorcycle wheels including a ramp and a clamp for holding one of the motorcycle wheels therein. The servicing rack is almost as large as the motorcycle and is not configured to fit under objects having a small floor-to-object bottom clearance.

Some common problems exist among these prior art jacks. One problem is that the minimum required clearance height between the ground and the load is five inches or more. Newly-manufactured motorcycles, however, may only have two or three inches of ground clearance. Therefore, to utilize commonly available lifting devices, the user is required to drive or push the motorcycle onto supporting planks or blocks to artificially create the necessary minimum clearance for the prior art lifting device. Such an operation can be difficult and dangerous. It is, therefore, desirable to provide a low-profile lifting device that can accommodate the required low clearance without any extra lifting operation.

Additionally, the considerable extension of a load over a jack very often causes the problem of load instability. It is, therefore, desirable to provide additional stability when lifting the load. Additional stability is especially necessary for a small profile jack that is used on motorcycles having a low ground clearance.

Conventional jacks typically have flat lifting surfaces. Some motorcycles, however, do not have uniformly flat lower surfaces. Alternatively, the lifting surfaces may not exist below the center of gravity of the motorcycle. It is, therefore, necessary to provide a supporting device that is adjustable according to different lower surfaces of the motorcycle.

In general, hydraulic jacks may be subjected to unexpected loss of hydraulic pressure. Such loss of pressure may be dangerous, and could cause damage or injury. Some of the existing jacks on the market have employed safety devices to reduce pressure loss hazards. Such safety devices are generally of the nature of pawls that engage fixed "teeth" on the jack frame. However, such devices suffer from the drawback that the user must remember to engage the safety device.

Another drawback of these devices lies in the release of the safety devices. Due to the symmetrical nature of these jacks, it is common practice to employ a safety pawl on either side of the device. When releasing such a safety device, therefore, the user must retract one pawl on each side of the jack while simultaneously rotating the release valve to lower the jack. The great difficulty in performing three operations simultaneously, without assistance from another person, leads to non-use of the safety device. It is, therefore, very important to provide a safety device that can be released easily by a single operator.

It is accordingly an object of the present invention to provide an adjustable receiving element that may be used to lift loads that may not be conveniently lifted by a lifting device with a typical flat lifting surface. The adjustable receiving element can be used either as an attachment to an existing lifting device or incorporated into a lifting device.

SUMMARY OF THE INVENTION

With the foregoing and other objects in view, an adapter is provided which allows a jack to engage a work piece variably within three dimensions of connection, and to maintain the work piece in a stable horizontal contact during the entire lift by the jack. Specifically, the adapter allows a holding connection with the work piece in at least three unrelated points of contact within three dimensions, such that the points of contact are not within a single horizontal line or plane yet each of points of contact equally bear the load of the work piece.

In the preferred embodiment of the present invention, each of several connection arms within an adapter is individually adjustable within three-degrees-of-movement. The removable adapter assembly of the preferred embodiment of the present invention, includes an adapter frame having threaded holes and a connector for releasably attaching the frame to the head of the jack, and three-degree-of-movement adapter arms rotatably inserted into a respective one of the threaded holes for raising and lowering each of the arms with respect to the frame, the arms each having a threaded portion with a top end, a horizontal head portion having a closed slot, the head portion fixedly attached to the top end of the threaded portion, and a cushioned receiver rotatably and slidably mounted in the slot.

In accordance with an added feature of the preferred embodiment of the present invention, the adapter frame is rectangular, in particular, square.

In accordance with another feature of the preferred embodiment of the present invention, the threaded holes are four threaded holes and the three-degree-of-movement adapter arms are four three-degree-of-movement adapter arms.

In accordance with an additional feature of the preferred embodiment of the present invention, the connector includes a second set of holes formed in the frame and a fastener for removably fastening the frame to the head of the jack.

In accordance with a further feature of the preferred embodiment of the present invention, each of the second set of holes is formed at each corner of the frame.

In accordance with another added feature of the preferred embodiment of the present invention, each of the second set of holes is threaded.

In accordance with another additional feature of the preferred embodiment of the present invention, each of the second set of holes has center points and the head of the jack has securing holes with centers aligned with the center points.

In accordance with another further feature of the preferred embodiment of the present invention, each of the second set of holes is threaded and the fastener is a threaded bolt.

In accordance with a further added feature of the preferred embodiment of the present invention, the securing holes have a diameter and the threaded bolt has a head wider than the diameter.

In accordance with a further additional feature of the preferred embodiment of the present invention, the head has wing extensions.

In accordance with an added feature of the preferred embodiment of the present invention, each of the securing holes is threaded and the fastener is a threaded bolt.

In accordance with an additional feature of the preferred embodiment of the present invention, each of the second set of holes has a diameter and the threaded bolt has a head wider than the diameter.

According to a concomitant feature of the preferred embodiment of the present invention, the cushioned receiver has a sliding and rotating connector with a top side and a V-shaped head with a bottom of the head attached to the top side of the sliding and rotating connector.

Other features that are considered as characteristic for the invention are set forth in the appended claims.

Although the invention is illustrated and described herein as embodied in a lifting device assembly, it is, nevertheless, not intended to be limited to the details shown because various modifications and structural changes may be made therein without departing from the spirit of the invention and within the scope and range of equivalents of the claims.

The construction and method of operation of the invention, however, together with additional objects and advantages thereof, will be best understood from the following description of specific embodiments when read in connection with the accompanying drawings.

DETAILED DESCRIPTION OF THE PREFERRED EMBODIMENTS

Before explaining the preferred embodiment of the present invention in detail, it is to be understood that this invention is not limited in its application to the details of construction and configuration of parts illustrated in the accompanying drawings or described in the description. The terminology employed in this description is utilized to explain the invention to persons skilled in the art and is not intended to be limiting as to the embodiments described.

Figure 1:
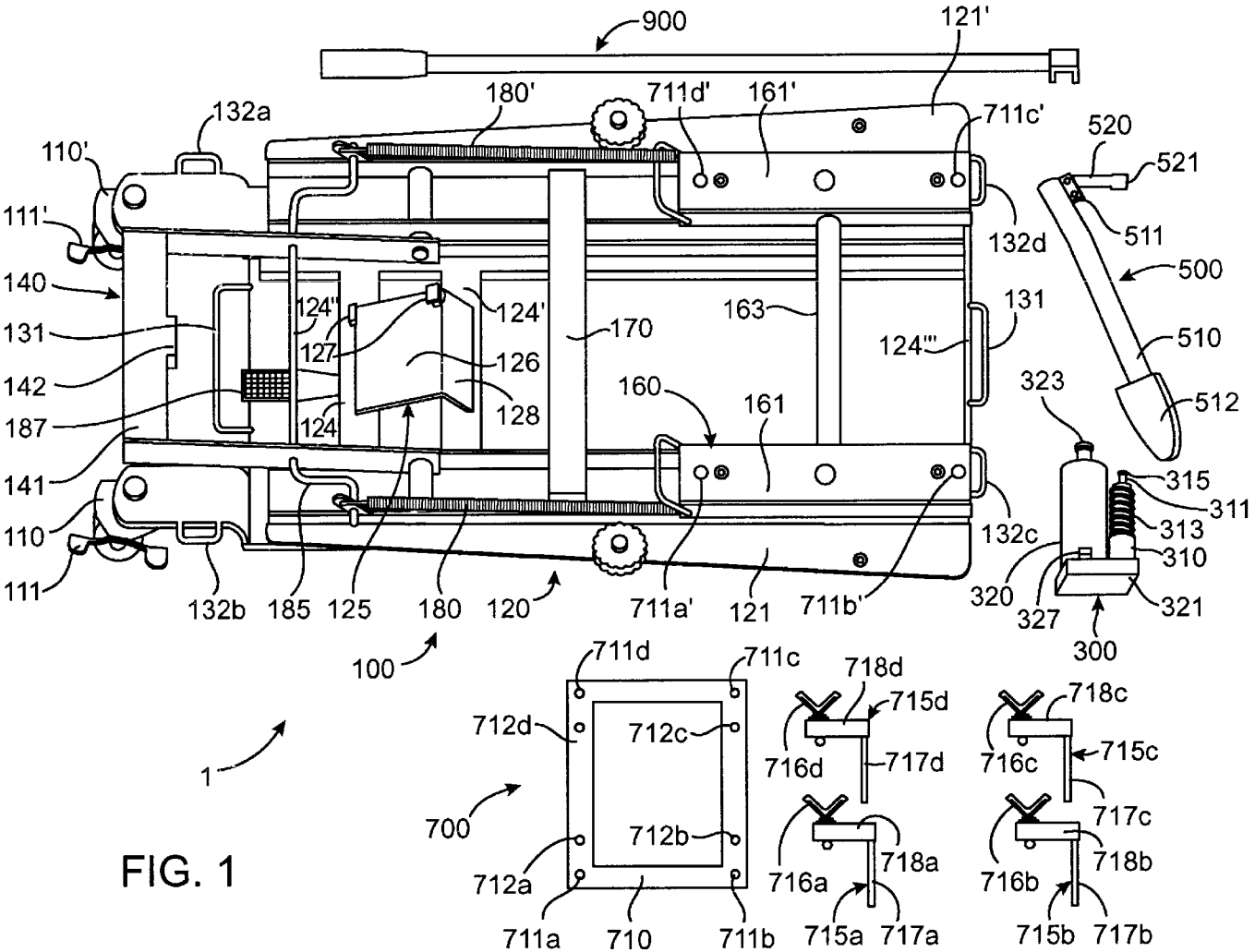
FIG. 1 is a perspective view from above the disassembled lifting device assembly and removable adapter assembly according to a preferred embodiment of the invention.

Referring now to the figures of the drawings in detail, and first particularly to FIG. 1, there is shown the lifting device assembly according to the preferred embodiment of the present invention in a disassembled state. The lifting device assembly 1 includes a base assembly 100, a hydraulic ram assembly 300, a foot pedal assembly 500, a removable adapter assembly 700, and a pulling handle 900.

The hydraulic ram assembly 300 includes a pump piston 310, a housing 320, and a ram base 321. The pump piston 310 has a piston 311 with a pinhole 315 formed in the top end thereof and a return spring 313 mounted surrounding the piston 311. The housing 320 has a cylinder 322, a plunger 325 (see FIG. 2) movable within the cylinder 322 and a cap 323 mounted on the top end of the plunger 325.

Figure 3:
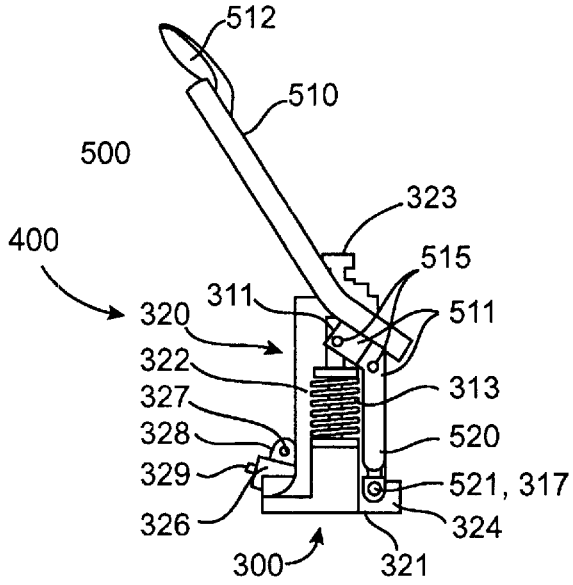
FIG. 3 is a side view of the hydraulic ram assembly and the foot pedal assembly of the lifting device assembly of FIGS. 1 and 2.

As can be better seen from FIG. 3, a pinhole 317 is formed in a protrusion 324 on the ram base 321. Another pinhole 327 is formed in another protrusion 328 located on the top of an air exit cylinder 326 connected to the cylinder 322 at the bottom end thereof. An air leak button 329 fits in the opening of the air exit cylinder 326.

The foot pedal assembly 500 includes a pump lever 510 with two brackets 511 at one end of the pump lever 510, a foot pedal 512 mounted at the other end of the pump lever 510, and a linkage 520. The linkage 520 is pivotably connected to the pump lever 510 at the end close to the two brackets 511 through a pivot pin and a cotter pin. Through-holes 515 are formed in the two brackets 511. Another through-hole 521 is formed at the free end of the linkage 520.

FIG. 3 shows the assembling relationship between the foot pedal assembly 500 and the hydraulic ram assembly 300. The foot pedal assembly 500, including the pump lever 510, pivotally coupled to the linkage 520, is first connected to the ram base 312 by a first pin passed through pinholes 317, 521 of the base 321 and the linkage 520 and secured with a cotter pin. Second and third pins are inserted, respectively, through the first bracket 511 of the pump lever 500 and the upper through-hole of the linkage 520, and through the second bracket 511 of the pump lever 500 and the through-hole of the piston 311, and are secured with a cotter pin. The jacking assembly 400 is, thus, formed.

Figure 2:
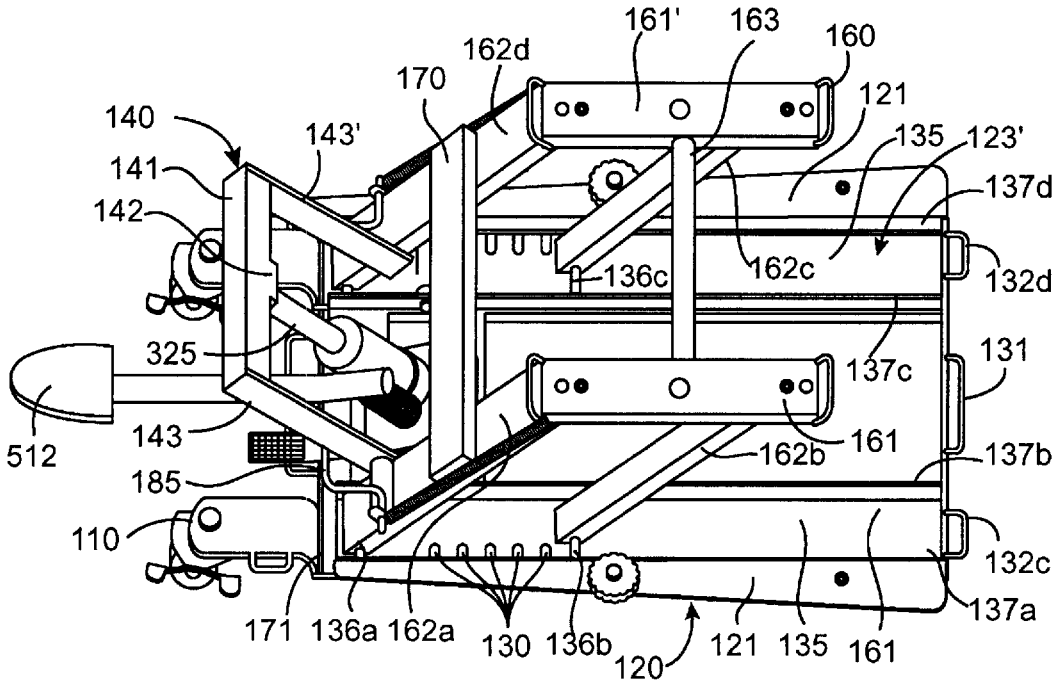
FIG. 2 is a perspective view from above the assembled lifting device assembly according to a preferred embodiment of the invention with a support frame in a lifted position.

As shown in FIGS. 1 and 2, the base assembly 100 has a base frame 120, a front ram support 140, and a parallelogram support frame 160 for carrying a load. The base frame 120 is formed from parallel base members 121, 121' with casters 110, 110' at one end of each base member 121, 121' to facilitate the transportation of the lifting device 1. The parallel base members 121, 121'0 define a base plane.

The casters 110, 110' can be fixed by locking devices 111, 111', referred to as loop straps. The parallel base members 121, 121' are each formed with a recess 123, 123' (as best seen from FIG. 2) to allow the parallelogram support frame 160 to nest therein when the lifting device assembly 1 is in a down or lowered position. Thus, in cross-section, the base members 121, 121' each have a substantially U-shape.

A plurality of ratchet slots 130 are formed in bottom surfaces 135, 135' of each of the parallel base members 121, 121'. Two center beams 124, 124' and two end beams 124", 124"' fixedly connect the parallel base members 121, 121' to one another. The two end beams 124", 124"' respectively connect each of the ends of the support members 121, 121'.

In addition to the base members 121, 121', the support members 161, 161' and the lifting arms 162*a*, 162*b*, 162*c*, 162*d* all employ "open" shapes so that they can nest within each other, and, therefore, reduce the overall height of the lifting device assembly 1 in its lowered position. Preferably, the overall height in the lowered position is less than five inches, and, particularly, approximately three inches or less.

A jack assembly base 125 is formed between the two center beams 124, 124' and fixedly connected thereto. The jack assembly base 125 includes a first, sloped guide surface 126 and a second, substantially upright surface 128. The sloped guide surface 126 extends in a plane at an angle to a base plane. Attachment clamps 127 are formed on the slope guide surface 126 to hold the jacking assembly 400 thereon.

A release pedal 187 is pivotably connected to one of the center beam 124, the guide surface 126, or the ram base 321 after the hydraulic ram assembly 300 has been connected to the base assembly 100. Preferably, the release pedal 187 is pivotably connected to the ram base 321.

Figure 8:
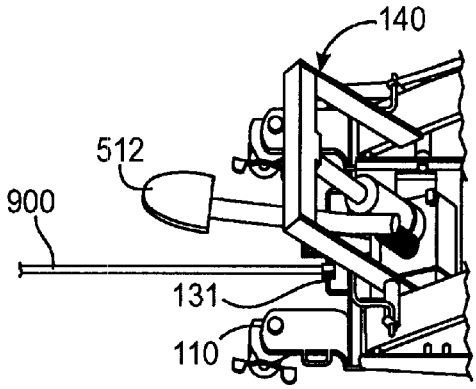
FIG. 8 is a partial perspective view from above the lifting device assembly of FIG. 1 showing the pulling handle.

A loop 131 can be formed on one or both of the end beams 124", 124"' for engaging with a pulling handle 900 to facilitate the transportation of the lifting device 1. FIG. 8 illustrates the pulling handle 900 engaged with loop 131 for moving the lifting device 1. Additional loops 132*a*, 132*b*, 132*c* and 132*d* can be formed at various portions of the base frame 120 to facilitate adjusting a position of the lifting device assembly 1 under a load.

As can be seen in FIG. 2, the parallelogram support frame 160 has two parallel, horizontal support members 161, 161' pivotally connected to and supported by the top ends of four lifting arms 162*a*, 162*b*, 162*c*, 162*d*. The bottom ends of these four lifting arms 162*a*, 162*b*, 162*c*, 162*d* are pivotably connected to the two horizontal base members 121, 121' through bolts 136*a*, 136*b*, 136*c*, 136*d* (136*d* cannot be seen in the drawings). The bolts 136*a*, 136*b*, 136*c*, 136*d* are supported through holes formed in the U-shape of the side surfaces 137*a*, 137*b*, 137*c*, 137*d* of the base members 121, 121' and fixed to the side surfaces by nuts.

A support bar 163 is fixedly connected, preferably by welding, between the two parallel support members 161, 161' to increase the strength of the support frame 160. A connecting beam 170 is fixedly attached, preferably by welding, on the two front lifting arms 162*a*, 162*d*.

The front ram support 140 includes a lifting beam 141 with a bracket 142 formed on the bottom surface thereof, and two lifting legs 143, 143'. Together, the lifting beam 141 and two lifting legs 143, 143' form an upside down, substantially U-shape. The bracket 142 is constructed to removably receive the cap 323 of the housing 320 when the hydraulic ram assembly 300 is connected to the lifting device assembly 1. The lifting legs 143, 143' are pivotably connected to the front lifting arms 162*a*, 162*d* on a pivot shaft at a pivot point lower on the front lifting arms 162*a*, 162*d* than the attachment point of the connecting beam 170. Preferably, the pivot point of the lifting legs 143, 143' is in the bottom one-third of the lifting legs 143, 143'.

Figure 10:
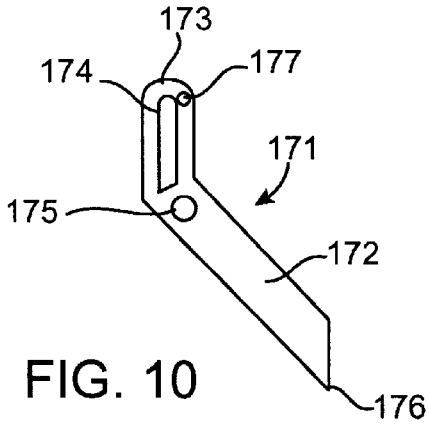
FIG. 10 is a side elevational view of a safety pawl of the lifting device assembly of FIG. 1.

Safety pawls 171, 171' are pivotally connected on the respective pivot shaft of the lifting legs 143, 143'. FIG. 10 illustrates one of the safety pawls 171, which has a locking part 172 with a locking point 176, a pivot hole 175 for receiving the pivot shaft, and a release part 173 with a long slot 174 formed therein. Alternatively, the slot 174 can also be the pivot hole.

Springs 180, 180' are connected between one end of the release part 173 of each safety pawl 171, 171' and a portion of the parallelogram support frame 160. Preferably, the springs 180, 180' are connected to an end of each support member 161, 161'. Alternatively, springs 180, 180' may also connect the safety pawls 171, 171' to the ends of the connecting beam 170.

As shown in FIG. 10, a hook hole 177 is formed in the end of the release part 173 of the safety pawl 171 to connect with a hook formed at one end of the spring 180. The locking point 176 of the locking part 172 of the safety pawl 171 engages within one of the slots 130 in the bottom surface 135 of the base member 121.

A release bar 185 is provided for substantially simultaneously releasing both of the safety pawls 171 from the slots 130. The release bar 185 is movably inserted in the long slot 174, preferably with a non-removable pin. Alternatively, the release bar 185 can also be pivotably fixed in the release part 173. Although only one of the safety pawl 171 is described above, it is to be understood that the other safety pawl 171' has the corresponding structure and is mounted on the other side of the lifting device 1.

Figure 4:
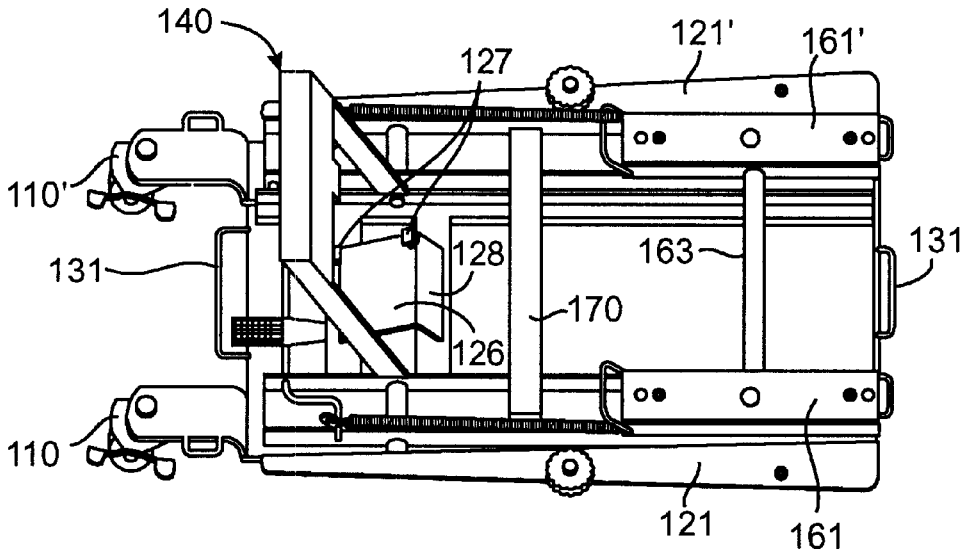
FIG. 4 is a perspective view of the base assembly of the lifting device assembly of FIGS. 1 and 2 showing that a front ram support has been lifted.
Figure 5:
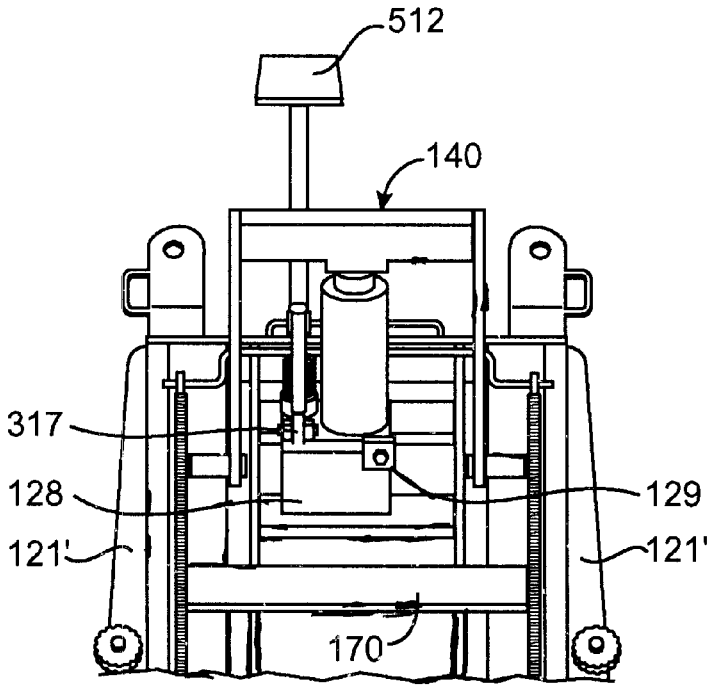
FIG. 5 is a partial perspective view from above the lifting device assembly of FIG. 1 showing the hydraulic ram assembly and the base assembly in an installed state.

FIGS. 4 and 5 illustrate how the jacking assembly 400 is connected to the base assembly 100. As shown in FIG. 4, the front ram support 140 is placed in a raised position. As shown in FIG. 5, with the foot pedal 512 of the foot pedal assembly 500 oriented toward the back (with respect to FIG. 5), the ram cap 323 is placed inside the bracket 142 of the front ram support 140 and the ram base 321 is aligned with at least one attachment clamp 127 attached to the slope guide surface 126, preferably, attached by welding. The entire jacking assembly 400 is secured to the guide surface 126 by tightening a bolt 129 of the clamp 127.

Figure 6:
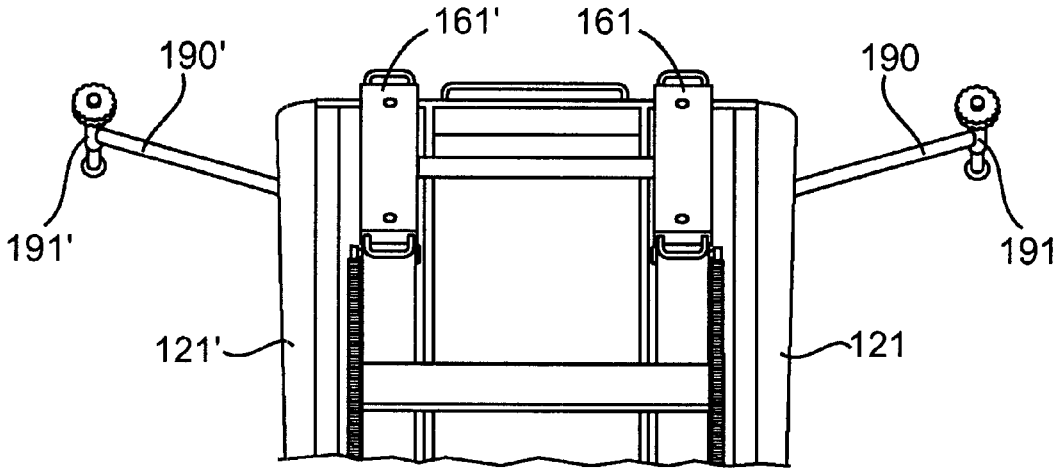
FIG. 6 is a partial perspective view from above the lifting device assembly of FIG. 1 showing the stabilizer arms.

As shown in FIG. 6, the base assembly 100 can have stabilizer arms 190, 190', preferably two in number, pivotably mounted at a side of the two base members 121, 121'. The stabilizer arms 190, 190' provide additional stability for the lifting device assembly 1 by extending the so-called "footprint" of the lifting device assembly 1 to a wider geography.

The lifting device assembly 1 has a length and a width, with the width being smaller than the length. Therefore, the lifting device assembly 1 is less stable along an extent of the width, than along the extent of the length. As such, it is desireable to extend the effective width of the device and/or extend the length of the device, depending on the orientation of the object to be lifted and balanced thereupon. To effectuate such an extension, stabilizer arms 190, 190' are provided.

In a preferred embodiment, the stabilizer arms 190, 190' extend the width of the device's footprint to at least two times the width of the device 1, as measured without such stabilizer arms 190, 190'. The stabilizer arms 190, 190' can be retracted or extended according to the needs of the user.

The stabilizer arms 190, 190' may be adjusted to provide side-to-side stability (width) or to enhance end-to-end stability (length) because they may be placed in one of many, separate, intermediate positions. If placed on the side of a base member 121, 121', for example, the stabilizer arms 190, 190' can rotate approximately through a 180 degree arc. Alternatively, if placed on the a corner of a base member 121, 121', for example, the stabilizer arms 190, 190' can rotate approximately through a 270 degree arc.

Adjustment feet 191, 191' can be provided at the furthest end of the stabilizing arms 190, 190' to provide even contact with potentially uneven ground or pavement surfaces. Preferably, the adjustment feet 191, 191' each have a disk-shaped foot, a height-adjustment knob, and a threaded rod connecting the foot to the knob. Thus, when the knob is turned clockwise, for example, the foot moves lower with respect to the base members 121, 121', and when the knob is turned counter-clockwise, for example, the foot raises from that lowered position. Preferably, the feet can be raised slightly above the bottom of the base members 121, 121' so that varying terrain can be accommodated.

Figure 7:
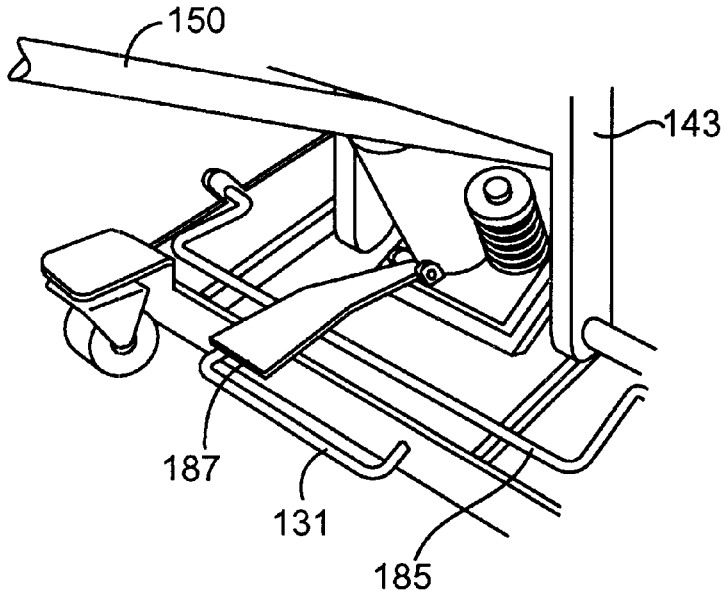
FIG. 7 is a partial perspective view from above the lifting device assembly of FIG. 1 showing the releasing assembly.

FIG. 7 illustrates the lowering device of the preferred embodiment of the present invention. As set forth above, depressing the pedal 187 begins the process for lowering the load on the lifting device assembly 1.

In an initial portion of the lowering movement, the pedal 187 presses down a first portion of the release bar 185 under the pedal 187. The downward movement of the first portion of the release bar 185 causes a corresponding pulling movement on the second portions of the release bar 185 that are connected to each of the two safety pawls 171, 171'. The pulling movement pivots the pawls 171, 171' such that a locking point 176 is removed from one of the slots 130 in the base members 121, 121'.

When the removal is complete, the safety pawls 171, 171' no longer prevent the support frame 160 from lowering, but the pressure existing within the ram assembly 300 does continue to prevent the support frame 160 from lowering. As such, pressing of the pedal 187 is continued to a second position in which a flange of the pedal 187 presses in the air leak button 329 of the ram assembly 300 to release the internal pressure within the housing 320.

Accordingly, the weight of the object and/or the support frame 160 causes the support frame 160 to lower towards a lowermost position nested within the base members 121, 121'. Because the release bar 185 is symmetrical with respect to the either side of the pressing point of the pedal 187, the safety pawls 171, 171' are substantially simultaneously released from the slots 130.

FIG. 8 illustrates an embodiment of the pulling handle 900 engaging the loop 131 at a side of the lifting device assembly 1 that is closest to the casters 110, 110'. It is to be understood that the pulling handle 900 may also engage with any other loop on the lifting device assembly 1 for moving the lifting device assembly 1 in different directions.

Figure 9:
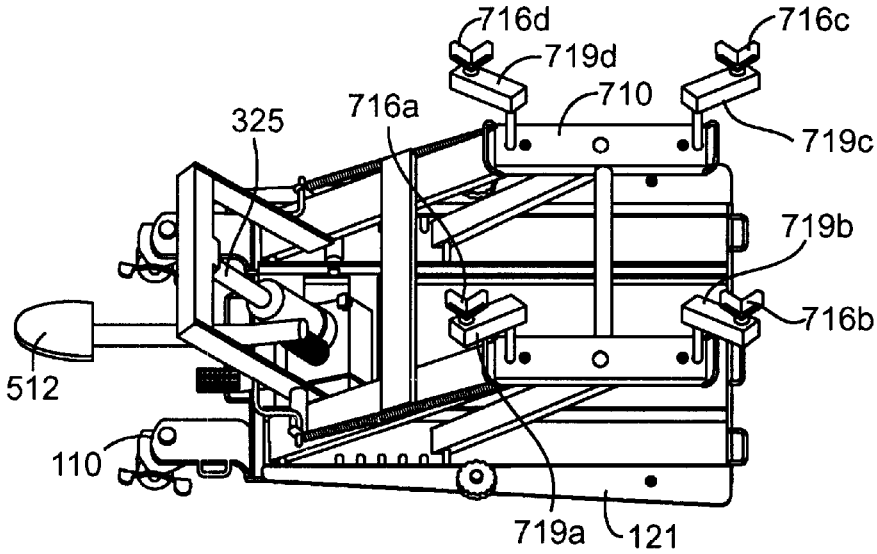
FIG. 9 is a perspective view from above the lifting device assembly of FIG. 1 showing the removable adapter assembly.

As shown in FIGS. 1 and 9, the removable adapter assembly 700 includes a substantially square adapter frame 710 having four screw holes **712*a*, 712*b*, 712*c*, 712*d* formed therein. The frame 710 also has four threaded adapter arms 715*a*, 715*b*, 715*c*, 715*d* that can be rotatably inserted in a respective screw hole 712*a*, 712*b*, 712*c*, 712*d* for raising and lowering each of the arms 715*a*, 715*b*, 715*c*, 715*d***.

The adapter frame 710 has another set of four through-holes **711*a*, 711*b*, 711*c*, 711*d* formed at each corner thereof for fixing the adapter frame 710 onto the support frame 160. Accordingly, the support members 161, 161' have four corresponding securing holes 711*a*', 711*b*', 711*c*', 711*d*'. The through-holes 711*a*, 711*b*, 711*c*, 711*d* and securing holes 711*a*', 711*b*', 711*c*', 711*d*'are aligned so that the frame 710 can be removably attached to the lifting device assembly 1** using, for example, screws or nuts and bolts.

Preferably, one of the two sets of four holes is threaded so that a single threaded bolt with a head larger than a diameter of the other hole can be used to secure the frame 710. In one preferred embodiment, the head has wing extensions so that a user can tighten the bolt without using a separate tool.

Preferably, the adapter frame 710 is rectangular or square. Each adapter arm **715*a*, 715*b*, 715*c*, 715*d* includes a vertical portion 717*a*, 717*b*, 717*c*, 717*d* formed with a thread and a horizontal head portion 718*a*, 718*b*, 718*c*, 718*d* having a lengthened slot 719*a*, 719*b*, 719*c*, 719*d* (see FIG. 8**).

A respective padded rotating receiver **716*a*, 716*b*, 716*c*, 716*d* is movably mounted within the slot. By moving the respective padded receiver 716*a*, 716*b*, 716*c*, 716*d* within the slot and turning the thread into the respective screw hole 712*a*, 712*b*, 712*c*, 712*d*, the height, rotation and extension of each padded receivers 716*a*, 716*b*, 716*c*, 716*d* can be adjusted individually so as to provide stable support for non-flat or irregular surfaces. Thus, each of the adapter arms 715*a*, 715*b*, 715*c*, 715*d* has a full three degrees of movement. The adapter frame assembly 700 can be used either as a retrofitted attachment to an existing lifting device or incorporated into the lifting device assembly 1** of the preferred embodiment of the present invention.

The following paragraphs describe the operation of the lifting device of the preferred embodiment of the present invention.

First, the lifting device assembly 1 is placed under a load to be lifted. If desired, the pulling handle 900 can be used to place the lifting device assembly 1. When the lifting device assembly 1 is located in the right position under the load, the foot pedal 512 is depressed. If desired, to provide additional stability, the stabilizer arms 190, 190' may be extended to a suitable position prior to depressing the foot pedal 512.

The return spring 313 provides the return action of each depression of the foot pedal 512. The plunger 325 of the ram assembly 300 lifts during each pumping action. Such lifting, in turn, raises the lifting beam 141 with respect to the base members 121, 121'. Because the bottom of the lifting beam 141 is connected to the two lifting arms 162*a*, 162*d*, a raising of the lifting beam 141 causes a corresponding counter-clockwise rotation (with respect to FIG. 2) of the lifting arms 162*a*, 162*d* about their pivot axis, which are within the recess 123, 123' of each base member 121, 121'. Because lifting arms 162*b*, 162*c* are connected to lifting arms 162*a*, 162*d* through the support members 161, 161', the entire support frame 160 raises with respect to the base members 121, 121'.

In the mean time, the springs 180, 180' provide a lifting force upon the end of each safety pawls 171, 171'. Thus, the locking point 176 of each safety pawl 171, 171' engages one of the slots 130 in the bottom surface 135 of the base members 121, 121' in the manner of a ratchet as the ram assembly 300 lifts. The lock prevents the support frame 160 from unintentionally lowering should the pressure in the ram assembly 300 be unexpectedly lost.

To lower the support frame 160, the release pedal 187 is pressed into an initial position whereby the release bar 185 under the release pedal 187 moves downward and, correspondingly, simultaneously pivots both of the safety pawls 171, 171' out of their respective slots 130. Specifically, the release bar 185 pulls down the end of the release part 173 of the locking pawl 171, 171' and disengages the locking point 176 from the slot 130.

The release pedal 187 is pressed further down to a final position where a flange on the pedal 187 contacts and presses in the air leak button 329. The air in the ram cylinder 322 slowly leaks out from the air exit cylinder 326. The plunger 325 and the parallelogram support frame 160 slowly lower down under the weight of the load.

While the manner, operation and principles of the present invention has been illustrated and described by a specific preferred embodiment, it is to be understood that numerous changes and modifications may be made without departing from the spirit and scope of the invention as defined in the appended claims.

What is claimed is:

1. In combination with a jack having a head, a removable adapter assembly comprising:

an adapter frame having:

threaded holes; and a connector for releasably attaching said frame to the head of the jack; and three-degree-of-movement adapter arms rotatably inserted into a respective one of said threaded holes for raising and lowering each of said arms with respect to said frame, said arms each having:

a threaded portion with a top end;

a horizontal head portion having a closed slot, said head portion fixedly attached to said top end of said threaded portion; and a cushioned receiver rotatably and slidably mounted in said slot.

2. The removable adapter assembly according to claim 1, wherein said adapter frame is square.

3. The removable adapter assembly according to claim 1, wherein:

said threaded holes are four threaded holes; and said three-degree-of-movement adapter arms are four three-degree-of-movement adapter arms.

4. The removable adapter assembly according to claim 1, wherein said connector includes:

a second set of holes formed in said frame; and a fastener for removably fastening said frame to the head of the jack.

5. The removable adapter assembly according to claim 4, wherein each of said second set of holes are formed at each corner of said frame.

6. The removable adapter assembly according to claim 4, wherein each of said second set of holes is threaded.

7. The removable adapter assembly according to claim 4, wherein:

each of said second set of holes has center points; and the head of the jack has securing holes with centers aligned with said center points.

8. The removable adapter assembly according to claim 4, wherein:

each of said second set of holes is threaded; and said fastener is a threaded bolt.

9. The removable adapter assembly according to claim 8, wherein:

said securing holes have a diameter; and said threaded bolt has a head wider than said diameter.

10. The removable adapter assembly according to claim 8, wherein said head has wing extensions.

11. The removable adapter assembly according to claim 4, wherein:

each of said securing holes is threaded; and said fastener is a threaded bolt.

12. The removable adapter assembly according to claim 11, wherein:

said second set of holes have a diameter; and said threaded bolt has a head wider than said diameter.

13. The removable adapter assembly according to claim 11, wherein said head has wing extensions.

14. The removable adapter assembly according to claim 1, wherein said cushioned receiver has:

a sliding and rotating connector with a top side; and a V-shaped head with a bottom of said head attached to said top side of said sliding and rotating connector.

15. In combination with a jack having a head, a removable adapter assembly comprising:

an adapter frame having:

threaded holes; and connectors for releasably attaching said frame to the head of the jack; and adapter arms inserted into a respective one of said threaded holes for raising and lowering each of said arms with respect to said frame, said arms each having:

a threaded shaft with a diameter; and a head portion having a width greater than the diameter, said head portion fixedly attached to said threaded shaft.

16. The removable adapter assembly according to claim 15, further comprising padding.

17. The removable adapter assembly according to claim 15, wherein said adapter frame comprises a pair of axial bars and a pair of transverse bars.

18. The removable adapter assembly according to claim 15, wherein said adapter frame defines an interior open space.

19. A jack assembly adapted for supporting an object, comprising:

a support frame having support frame holes;

an adapter frame having threaded holes;

connectors releasably coupling said adapter frame to said support frame, said connectors adapted for protruding downwardly into said support frame holes; and adapter arms inserted into a respective one of said threaded holes for raising and lowering each of said arms with respect to said adapter frame, said arms each having:

a threaded shaft with a diameter; and a head portion having a width greater than the diameter of the threaded shaft, said head portion fixedly attached to said threaded shaft.

20. The assembly according to claim 19, wherein the adapter frame further comprises padding.

21. The assembly according to claim 19, wherein said adapter frame comprises a pair of axial bars and a pair of transverse bars.

22. The assembly according to claim 19, wherein said adapter frame defines an interior open space.

* * * * *